US005240520A

United States Patent [19]

Tarui et al.

[11] Patent Number: 5,240,520

[45] Date of Patent: Aug. 31, 1993

[54] HIGH STRENGTH, ULTRA FINE STEEL WIRE HAVING EXCELLENT WORKABILITY IN STRANDING AND PROCESS AND APPARATUS FOR PRODUCING THE SAME

[75] Inventors: Toshimi Tarui; Syoji Sasaki; Hitoshi Tashiro; Hiroshi Sato, all of Kamaishi, Japan

[73] Assignee: Nippon Steel Corporation, Tokyo, Japan

[21] Appl. No.: 910,019

[22] PCT Filed: Nov. 19, 1991

[86] PCT No.: PCT/JP91/01582

§ 371 Date: Jul. 16, 1992

§ 102(e) Date: Jul. 16, 1992

[87] PCT Pub. No.: WO92/08817

PCT Pub. Date: May 29, 1992

[30] Foreign Application Priority Data

Nov. 19, 1990 [JP] Japan ..... 2-311651
Mar. 28, 1991 [JP] Japan ..... 3-065044

[51] Int. Cl.[5] ..... B24C 3/00; B24C 1/00; B32B 15/20

[52] U.S. Cl. ..... 148/532; 428/677; 428/607; 72/53

[58] Field of Search ..... 29/90.7; 72/53; 148/516, 518, 527, 530, 532, 333; 428/677, 607

[56] References Cited

U.S. PATENT DOCUMENTS 4,683,175 7/1987 Bakewell et al. ..... 148/532
4,960,473 10/1990 Kim et al.
5,118,906 6/1992 Kudoh et al. ..... 428/677

FOREIGN PATENT DOCUMENTS 218167 4/1987 European Pat. Off.
50-75933 6/1975 Japan .
56-10522 3/1981 Japan .
60-204865 10/1985 Japan .
62-109925 5/1987 Japan .
62-256950 11/1987 Japan .
62-279015 12/1987 Japan ..... 72/53
63-24046 2/1988 Japan .
1-292190 11/1989 Japan .
2-179333 7/1990 Japan .
2-263951 10/1990 Japan .
3-122213 5/1991 Japan ..... 75/53
531017 12/1940 United Kingdom. .

*Primary Examiner*—Deborah Yee
*Attorney, Agent, or Firm*—Cushman, Darby & Cushman

[57] ABSTRACT

A high-strength, ultra-fine wire having an excellent workability in stranding, comprising a steel comprised of, in terms of % by weight, 0.85 to 1.10% of C, 0.10 to 0.70% of Si, 0.20 to 0.60% of Mn, 0.10 to 0.60% of Cr, 0.005% or less of Al and optionally at least one member selected from 0.10 to 2.00% of Ni and 0.10 to 3.00% of Co with the balance Fe and unavoidable impurities and, provided thereon, a brass plating, the steel wire having a diameter of 0.1 to 0.4 mm and a tensile strength of 400 kgf/mm$^2$ or more, the surface of the brass plating being provided with indentations having a depth of 2 μm or less at intervals of 50 μm or less in a percentage area of indentations of 10 to 80%; and a process and apparatus for producing a high strength, ultra fine steel wire, comprising subjecting a steel wire material to a patenting treatment, brass plating and wire drawing and subjecting the steel wire material to a shot peening treatment in an air blast system while applying a tension to the steel wire material.

8 Claims, 7 Drawing Sheets

HIGH STRENGTH, ULTRA FINE STEEL WIRE HAVING EXCELLENT WORKABILITY IN STRANDING AND PROCESS AND APPARATUS FOR PRODUCING THE SAME

TECHNICAL FIELD

The present invention relates to a high strength, ultra fine steel wire provided with a brass plating for use as an element wire for a steel tire cord, a steel belt cord, etc., said steel wire having an excellent workability in stranding and a wire diameter of 0.1 to 0.4 mm and a tensile strength of 400 kgf/mm$^2$ or more, and a process and apparatus for producing the same.

BACKGROUND ART

In order to attain a reduction in the weight, an improvement in the fatigue strength, etc., there is an ever-increasing demand for an increase in the strength of an ultra fine steel wire. A very fine steel wire used for the reinforcement of tires of automobiles, various belts for industries, etc., has hitherto been produced by subjecting a hot-rolled wire material of a high carbon steel to a repeated intermediate wire drawing and a patenting treatment to bring the wire into a desired wire diameter and then subjecting the wire to a final patenting treatment, plating the treated wire for improving the wire drawability and the adhesion to rubber, and subjecting the plated wire to wet drawing to a predetermined wire diameter. For example, the steel tire cord is produced by finally twisting the element wire produced by the above-described method by a twisting machine, such as a double twister.

In the above-described manufacturing process, in order to attain an increase in the strength of an ultra fine steel wire, it is necessary to increase the strength of an element wire after the final patenting treatment or to increase the final wire drawing strain, but an increase in the strength of the element wire after the final patenting treatment or the wire drawing strain frequently gives rise to a breaking of a wire in the step of twisting after the wire drawing, which remarkably lowers the productivity. For this reason, for example, in the case of a steel wire having a wire diameter of 0.3 mmϕ wherein use is made of SWRS82A, the limitation of the tensile strength sufficient to withstand twisting is 340 kgf/mm$^2$, and it is difficult to produce an ultra fine steel wire having a higher strength on a commercial scale.

On the other hand, in order to improve the workability in stranding of a high carbon steel wire having an increased tensile strength, for example, Japanese Unexamined Patent Publication (Kokai) Nos. 60-204865 and 63-24046 and Japanese Examined Patent Publication (Kokoku) No. 3-23674 propose a high carbon wire material for an ultra fine wire less liable to breaking in the step of twisting, through the regulation of chemical ingredients such as C, Si, Mn and Cr. As apparent also from working examples, the tensile strength of the steel wire is 350 to 360 kgf/mm$^2$ at highest, which limits an increase in the strength of an ultra fine steel wire. Further, in order to improve the fatigue properties of the ultra fine steel wire, for example, Japanese Unexamined Patent Publication (Kokai) No. 2-179333 proposes a process for continuously producing an ultra fine wire having a high fatigue resistance, through a continuous projection of fine hard particles onto the surface of an ultra fine wire having a diameter of 0.5 mm or less to improve the residual tensile stress of the surface layer of the extra thin wire into a residual compression stress. Nevertheless, to convert a residual tensile stress in the surface layer of a high-strength of 400 kgf/mm$^2$ or more, ultra fine steel wire to a residual compression stress, it is necessary to conduct a high degree of shot peening, so that problems arise such as an increase in the surface roughness and peeling of a brass plating in the surface layer having a reduced thickness due to wire drawing.

DISCLOSURE OF THE INVENTION

The present invention has been made under the above-described circumstances, and an object of the present invention is to provide a steel wire capable of realizing a high-strength, ultra fine steel wire having an excellent workability in stranding through the prevention of an increase in the frequency of a breaking of a wire in the step of twisting during the production of a high strength, ultra fine steel wire having a wire diameter of 0.1 to 0.4 mm and a tensile strength of 400 kgf/mm$^2$ or more, by wire drawing, and a process and apparatus for producing the same.

First, the present inventors made a detailed analysis of the form of fracture in the breaking of wire which frequently occurs during twisting of a high strength, ultra fine steel wire. In the twisting of wire, a twisting stress, a tensile stress and a bending stress are applied to the steel wire, and as a result, it is apparent that, when the strength of the steel wire is increased, cracking (delamination) often occurs along the direction of wire drawing, as shown in FIG. 1, which causes a breaking of a wire in the twisting step. Accordingly, the present inventors analyzed the influence of chemical ingredients of a steel wire, the tensile strength after final patenting treatment, wire drawing strain, etc., on the occurrence of delamination, and made various studies into means of increasing the strength of an ultra fine steel wire to make it less liable to delamination.

Examples of the means of increasing the strength of an ultra fine steel wire include (1) the selection of chemical ingredients having a high tensile strength after patenting treatment, (2) the selection of chemical ingredients having a high percentage of work hardening in a wire drawing, and (3) an increase in the wire drawing strain. It has been found that the means for increasing the strength through the optimal selection of chemical ingredients having a high tensile strength and a high percentage of work hardening in wire drawing after the patenting treatment is most useful for preventing the occurrence of delamination, i.e., a breaking of a wire in the step of twisting the wire. Nevertheless, it has been also found that there is a limitation on the increase in the strength of an ultra fine steel wire having an excellent workability in stranding when only the above-described chemical ingredients are selected. The results of an example of the analysis of the relationship between the tensile strength of an ultra fine steel wire and the frequency of wire breaking in the wire twisting step is shown in FIG. 2. Even though use is made of a 0.88% C-0.49% Si-0.30% Mn-0.51% Cr system having a high tensile strength after the patenting treatment and a high percentage of work hardening in the wire drawing (marked ● in the drawing), the delamination often occurs when the tensile strength of the ultra fine steel wire exceeds 390 kgf/mm$^2$, so that the wire breaking frequency in the wire twisting step rapidly increases. ○ in the drawing shows the results in the case of an alloy of a 0.81% C-0.26% Si-0.48% Mn system (SWRS82A) commonly used for steel cords, and it is apparent that, in this case, the wire breaking frequency when twisting the wire is further rapidly increased.

Further studies were made into means for preventing the occurrence of delamination in a high strength, ultra fine steel wire, and as a result, it was found that, when the surface layer of the ultra fine steel wire is subjected to plastic deformation after wire drawing, the occurrence of delamination can be prevented even though the tensile strength exceeds 400 kgf/mm$^2$, which contributes to a significant improvement in the workability in stranding of an ultra fine steel wire having a high strength. Specifically, the wire breaking frequency in the twisting step can be significantly reduced in the wire twisting step by imparting homogeneous, fine indentations formed by plastic deformation to the surface of the ultra fine steel wire. As a result of a detailed analysis of the influence of indentations on the workability in stranding of wire, it was found that the intervals of indentations, the depth of indentations and the percentage area of indentations are important factors to an improvement in the workability in stranding of an ultra fine steel wire having a high strength, and it is important to conduct an optimal control of these factors.

It is known that the macroscopic residual tensile stress caused on the surface of the ultra fine steel wire significantly increases with an increase of the tensile strength of the ultra fine steel wire. In this case, it is considered that the heterogeneity of more microscopic residual stress in the circumferential direction and longitudinal direction of the ultra fine steel wire also is increased. The reason why the provision of indentations formed by plastic deformation on the ultra fine steel wire having a high strength contributes to the prevention of delamination is believed to be because the provision of indentations reduces the heterogeneity of the microscopic residual stress distribution.

For this reason, the present inventors made studies into various methods of providing homogeneous, fine indentations formed by plastic deformation on the surface of an ultra fine steel wire, and as a result, found that it is most useful for this purpose to subject the ultra fine steel wire after wire drawing to a shot peening treatment in an air blast system, wherein use is made of compressed air.

Specifically, it was found that, when the ultra fine steel wire is subjected to an optimal shot peening treatment, even though the strength of the ultra fine steel wire exceeds 400 kgf/mm$^2$, it is possible to produce a high strength, ultra fine steel wire less liable to breaking and having an excellent workability in stranding.

Such an optimal shot peening treatment can be attained by a shot peening treatment under a much milder conditions than in the case of the conventional shot peening treatment used for improving the fatigue strength. Therefore, even though the residual stress is on the side of the tensile stress, when the remaining residual stress is homogeneous, it is possible to significantly improve the workability in stranding of an ultra fine wire having a high strength.

In the ultra fine wire according to the present invention, a brass plating is provided on the surface thereof, for improving the adhesion to rubber. The shot peening treatment conditions should be taken into consideration so that the plating layer is not peeled.

The present invention has been made based on the above-described finding, and provides a high strength, ultra fine steel wire having an excellent workability in stranding, comprising a steel comprised of, in terms of % by weight, 0.85 to 1.10% of C, 0.10 to 0.70% of Si, 0.20 to 0.60% of Mn, 0.10 to 0.60% of Cr, 0.005% or less of Al and optionally at least one member selected from 0.10 to 2.00% of Ni and 0.10 to 3.00% of Co with the balance consisting of Fe and unavoidable impurities, and provided thereon, a brass plating layer, said steel wire having a diameter of 0.1 to 0.4 mm and a tensile strength of 400 kgf/mm$^2$ or more, the surface of the brass plating being provided with indentations formed by plastic deformation having a depth of 2 μm or less at intervals of 50 μm or less in a percentage area of indentations of 10 to 80%; a process for producing a high strength, ultra fine steel wire, comprising subjecting a steel wire material comprising said ingredients to a patenting treatment so as to have a tensile strength of 145 to 165 kgf/mm$^2$, plating the treated steel wire material with brass, subjecting the plated steel wire material to wire drawing under a true strain of 3.7 to 4.5 to form a steel wire having a diameter of 0.1 to 0.4 mm, and subjecting the steel wire to a shot peening treatment in an air blast system through the use of compressed air under conditions of a shot grain diameter of 100 μm or less, a HV hardness of a shot grain of 700 or more, a Sp value [Sp=air blast pressure (kgf/cm$^2$)×shot peening treatment time (sec)]]of 5 to 100 kgf/cm$^2$.sec.

BEST MODE OF CARRYING OUT INVENTION

Figure 1:
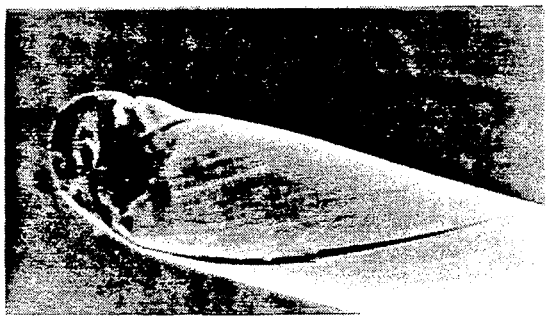
FIG. 1 is a scanning electron photomicrograph showing an example of a fracture of wire breaking caused by delamination when twisting a high strength, ultra fine steel wire.

The present invention will now be described in more detail.

First, the expression "high strength, ultra fine steel wire having an excellent workability in stranding" used in the present invention is intended to mean that the wire breaking frequency per 1000 kg of an ultra fine steel wire when twisting an ultra fine steel wire having a tensile strength of 400 kgf/mm$^2$ or more is 5times or less. When the breaking frequency exceeds 5 times, the productivity becomes so low that the product is not a high strength, ultra fine steel wire having an excellent workability in stranding.

The reason for the limitation of the ingredients of a steel having a good wire drawability and able to be subjected to a patenting treatment to have a tensile strength of 145 to 165 kgf/mm$^2$ and subjected to wire drawing to finally produce an ultra fine steel wire having a good workability in stranding and a high strength of 400 kgf/mm$^2$ or more, as intended in the present invention, will be now described.

C: C has the effect of increasing the tensile strength after a patenting treatment and enhancing the percentage of work hardening in wire drawing, which enables the tensile strength of the ultra fine steel wire to be enhanced with a less wire drawing strain. Consequently, it becomes possible to produce an ultra fine steel wire having a good workability in stranding and a high strength of 400 kgf/mm$^2$ or more. When the C content is less than 0.85%, it is difficult to obtain a tensile strength of 145 kgf/mm$^2$ or more after the patenting treatment even when an alloying element is added. Further, in this case, the percentage of work hardening in wire drawing is so small that it is impossible to obtain a strength of 400 kgf/mm$^2$ or more in terms of the tensile strength of an ultra fine steel wire, and even though the strength is increased to 400 kgf/mm$^2$ or more by increasing the wire drawing strain, the workability in stranding is poor. On the other hand, when the C content exceeds 1.1%, proeutectoid cementite precipitates on a grain boundary of austenite during the patenting treatment, to thus deteriorate the wire drawability, a breaking of the wire frequently occurs in the wire drawing or twisting step. For this reason, the C content is limited to 0.85 to 1.10%.

Si: Si is useful for strengthening ferrite in pearlite and deoxidizing a steel. When the Si content is less than 0.1%, the above-described effect cannot be expected, and when the content exceeds 0.7%, a hard $SiO_2$ inclusion is liable to occur. For this reason, the Si content is limited to 0.1 to 0.7%.

Mn: Mn is an element necessary for not only deoxidation and desulfurization but also for enhancing the tensile strength after the patenting treatment. When the Mn content is less than 0.2%, the above-described effect cannot be attained, and the content exceeds 0.6%, the effect is saturated and the treatment time needed for completing the pearlite transformation at the patenting treatment becomes so long that the productivity is lowered. For this reason, the Mn content is limited to 0.2 to 0.6%.

Cr: Cr is an element useful for reducing the space between cementites of pearlite, to enhance the tensile strength after a patenting treatment, and particularly, for improving the percentage of work hardening in wire drawing, and is indispensable for improving the workability in stranding of a high-strength, ultra-fine steel wire. When the Cr content is less than 0.1%, the above-described function is poor, and when the content exceeds 0.6%, the time needed for completing the pearlite transformation at the patenting treatment becomes so long that the productivity is lowered. For this reason, the Cr content is limited to 0.1 to 0.6%.

Al: Al becomes liable to form an $Al_2O_3$ inclusion having the largest hardness in the inclusions of the steel when the Al content exceeds 0.005%, which is a cause of wire breaking during wire drawing or twisting. For this reason, the Al content is limited to 0.005% or less.

The high strength, ultra fine steel wire having an excellent workability in stranding according to the present invention may contain, besides the above-described elements, at least one of 0.1 to 2.0% of Ni and 0.1 to 3.0% of Co.

Ni: Ni has the effect of improving the wire drawability of pearlite produced by transformation at the patenting treatment, and further, improving the workability in stranding of the high strength, ultra fine steel wire. When the Ni content is less than 0.1%, the above-described effect cannot be attained, and when the content exceeds 2.0%, the effect corresponding to the amount of addition cannot be satisfactorily attained. For this reason, the upper limit of the Ni content is set to 2.0%.

Co: As with Ni, Co has the effect of improving the wire drawability of pearlite produced by transformation at the patenting treatment, and improving the workability in stranding, and further, increasing the transformation rate of pearlite to enhance the productivity of the patenting treatment. When the Co content is less than 0.1%, the effect of the above-described function is unsatisfactory, and when the content exceeds 3.0%, the effect is saturated. For this reason, the Co content is limited to 0.1 to 3.0%.

Although there is no particular limitation on other elements, the contents of P, S and N are preferably 0.015% or less, 0.015% or less, and 0.005% or less, respectively.

The reason for the limitation of the tensile strength after the patenting treatment will be now described.

The tensile strength after the patenting treatment is preferably as high as possible, because an ultra fine steel wire having a high strength can be produced under a low wire drawing condition, which contributes to an improvement in the workability in stranding. Nevertheless, when the steel wire material is subjected to a patenting treatment at a low temperature, to have a tensile strength exceeding 165 kgf/mm$^2$, pearlite having a deteriorated wire drawability or bainite harmful to the wire drawability often occur, and thus the wire breaking frequently occurs when drawing and twisting a wire. On the other hand, when the steel wire material is subjected to a patenting treatment at a high temperature, to have a tensile strength of less than 145 kgf/mm$^2$, an intended ultra-fine steel wire having a high strength of 400 kgf/mm$^2$ or more cannot be obtained, or a very high wire drawing strain becomes necessary for increasing the tensile strength to 400 kgf/mm$^2$ or more, so that wire workability in stranding is poor. Therefore, the tensile strength after the patenting treatment is limited to 145 to 165 kgf/mm$^2$. As long as the components fall within the scope of the present invention, a tensile strength of 145 to 165 kgf/mm$^2$ after the patenting treatment can be attained when the patenting treatment temperature is from 560° to 600° C.

In the wire drawing, to bring the tensile strength of an ultra fine steel wire having a wire diameter of 0.1 to 0.4 mm into 400 kgf/mm$^2$ or more through the use of a steel wire having a tensile strength of 145 to 165 kgf/mm$^2$, it is necessary for the wire drawing strain to be 3.7 or more in terms of the true strain (true strain $=2\times\ln(D/d)$ wherein D is a wire diameter at the time of the patenting treatment and d is a final wire diameter). On the other hand, when wire drawing is conducted under a true strain exceeding 4.5, the ductility is lowered and the a breaking of a wire frequently occurs in the wire drawing or twisting of a wire. For this reason, the wire drawing strain is limited to 3.7 to 4.5 in terms of the true strain.

The reason for the limitation of the distribution, depth and percentage area of indentations formed by plastic deformation on the surface layer of the ultra fine steel wire important to the improvement in the workability in stranding of an ultra fine steel wire having a tensile strength of 400 kgf/mm$^2$ or more contemplated in the present invention, and the reason for the limitation of shot peening conditions for attaining this purpose, will be now described.

Figure 8:
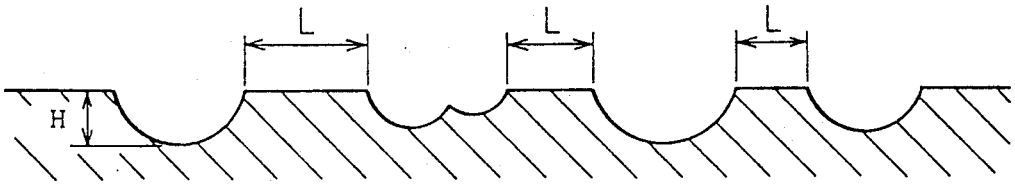
FIG. 8 is a schematic diagram showing indentations formed by a plastic deformation of an ultra fine steel wire on the surface of an ultra fine steel wire.

First, the reason for the limitation of the indentation formed by plastic deformation on the surface layer of the ultra fine steel wire will be described. As schematically shown in FIG. 8, the term "depth of indentations (H)" used in the present invention is intended to mean the depth from the surface of the steel wire, and the term "intervals of indentations (L)" used in the present invention is intended to mean the distance between one indentation and an adjacent indentation. Further, the term "percentage area of identations" is intended to mean a value determined by the equation: percentage area of indentations $=B/A\times100\%$, wherein A represents an area of a test piece and B represents a total area of indentations. The measurement of these values can be easily conducted by use of a scanning electron microscope.

Depth of indentations: When the depth of indentations exceeds 2 μm, stress concentrates at the indentations, which causes not only a frequent wire breaking when twisting a wire but also a lowered fatigue strength. On the other hand, when the depth exceeds 2 μm, the brass plating of the surface layer of the steel wire becomes liable to peeling, and the adhesion to rubber is also lowered. For this reason, the depth of indentations is limited to 2 μm or less.

Intervals of indentations: No satisfactory effect of improving the workability in stranding can be attained when indentations are evenly provided in the longitudinal direction and the circumferential direction of the ultra indentations are limited to 50 μm or less.

Figure 3:
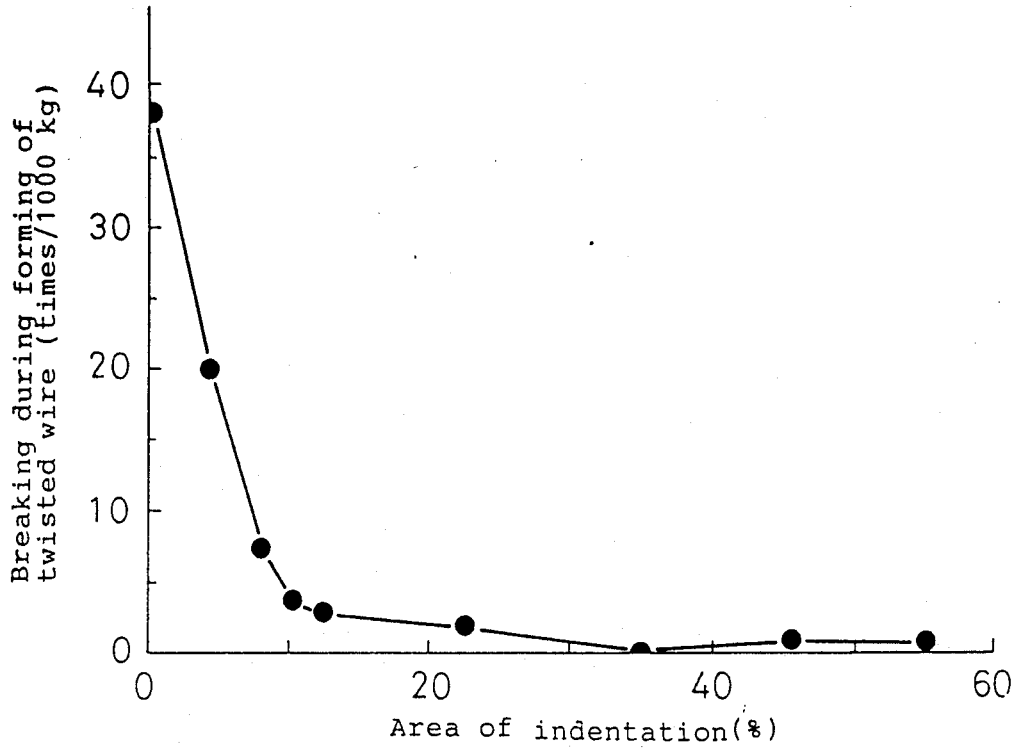
FIG. 3 is a diagram showing the results of an example of an analysis of the relationship between the percentage area of indentations formed by plastic deformation on the surface layer of an ultra fine steel wire and the wire breaking frequency when twisting a wire.

Percentage area of indentations: As shown in FIG. 3, the effect of improving the workability in stranding of wire is small when the percentage area of indentations is less than 10% or less. On the other hand, when the percentage area of indentations exceeds 80%, the effect of improving the workability in stranding of wire is saturated, and further, the brass plating layer becomes liable to peeling, whereby the adhesion to rubber is lowered. For this reason, the percentage area of indentations is limited to 10 to 80%.

FIG. 3 shows the relationship between the percentage area of indentations of a steel wire produced under conditions of Run No. 16 of Example 2 and the wire breaking frequency when twisting the wire.

Figure 9A:
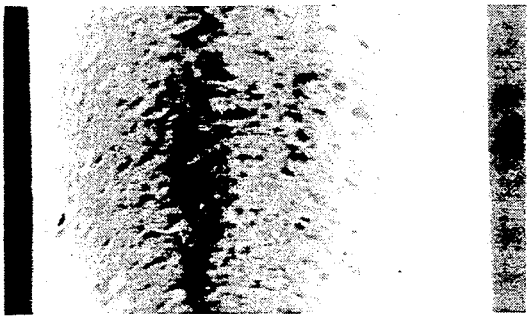
FIGS. 9*a* and 9*b* is a scanning electron photomicrograph showing an example of the state of the surface of an ultra fine steel wire subjected to a shot peening treatment and an ultra fine steel wire produced by the conventional process.
Figure 9B:
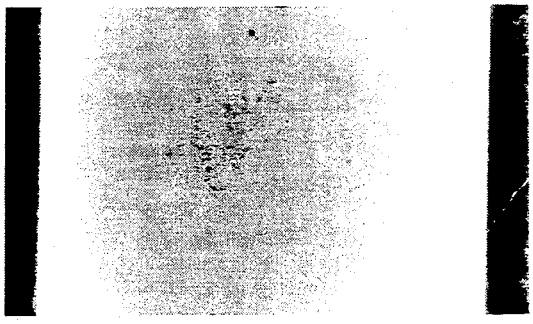
Figure 2:
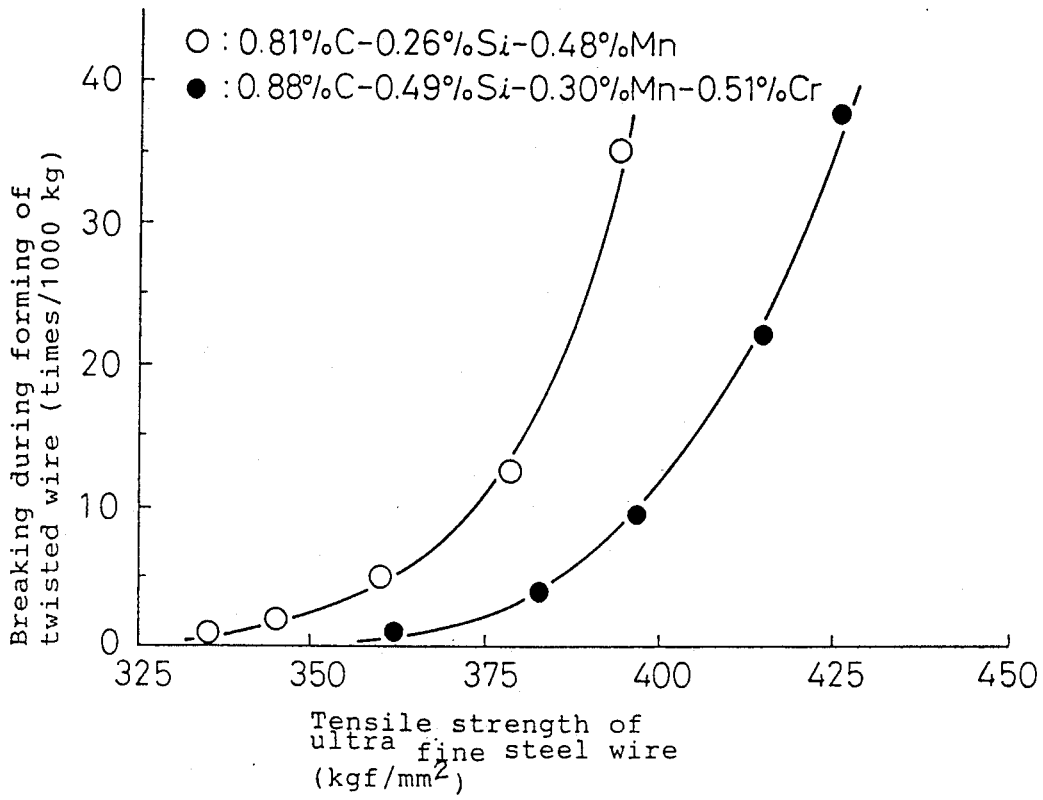
FIG. 2 is a diagram showing the results of an example of an analysis of the relationship between the tensile strength of an ultra fine steel wire and the wire breaking frequency when twisting a wire.

An example of a high strength, ultra fine steel wire having the above-described indentations is shown in FIG. 9. In an ultra thin steel wire having plastically deformed indentations shown in FIG. 9*a*, even when the tensile strength exceeds 400 kgf/mm$^2$, the wire breaking frequency when twisting a wire is so small that steel cords can be produced with a very high efficiency. FIG. 9*b* shows the appearance of an ultra fine steel wire by the conventional process, i.e., produced without a shot peening treatment.

The reason for the limitation of the shot peening conditions for providing plastically deformed indentations on the surface layer of the high strength, ultra fine steel wire will be now described. As a result of various studies of the shot peening method, it was found that a method wherein a shot grain is blown against the steel wire through an blast nozzle in an air blast system through the use of compressed air is best suited for efficiently conducting the shot peening treatment of an ultra-fine steel wire. Therefore, in the present invention, use is made of the above-described shot peening method. Since the purpose of the shot peening treatment used in the present invention is different from that of the shot peening treatment conducted for improving the fatigue strength of gears, shafts, etc., the shot peening treatment used in the present invention is characterized in that the shot peening treatment is conducted under much milder conditions that those in the case of the conventional shot peening. For example, when the measurement of arc height was attempted through the use of a test piece N in conformity with the standards established by Japan Spring Manufacturers Association (JSMA) (operation standard for shot peening), the arc height under proper shot peening conditions of the present invention was 0.1 mmN or less. Therefore, it is difficult to measure the arc height and coverage indicating the degree of shot peening, particularly the arc height. For this reason, the shot grain diameter, HV hardness of the shot grain, and parameter Sp indicating the degree of shot peening are newly adopted in the present invention. Specifically, the parameter Sp indicates the degree of shot peening and is obtained by multiplying the air blast pressure (kgf/cm$^2$) by the shot peening treatment time (sec).

The relationship between the parameter Sp at the shot peening treatment and the wire breaking frequency when twisting a wire will be now described in detail.

Figure 4:
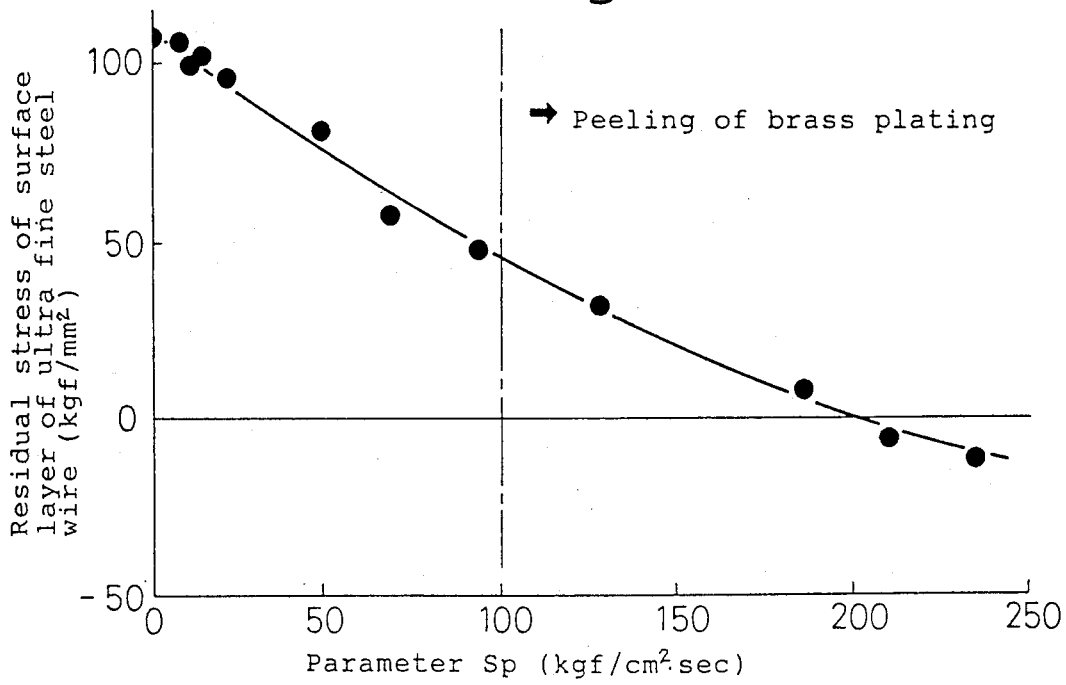
FIG. 4 is a diagram showing the results of an example of an analysis of the relationship between the residual stress of the surface layer of an ultra fine steel wire and the parameter Sp during a shot peening treatment.

FIG. 4 shows the relationship between the parameter Sp (kgf/cm$^2$.sec) and the residual stress (kgf/mm$^2$) of the surface layer of an ultra fine steel wire with respect to a steel wire produced under conditions of Run No. 19 of Example 2, with the residual stress being 107 kgf/mm$^2$ when the parameter Sp is zero, i.e., when no shot peening of the present invention was conducted. The residual stress indicates a macroscopic stress of an ultra fine steel wire, which is a value determined by putting a number of ultra fine steel wires side by side without a space therebetween, and measuring the stress by an X-ray method.

In the drawing, when the parameter Sp is gradually increased through a shot peening of the present invention, the residual stress is lowered. When the parameter Sp reaches 100 kgf/cm$^2$.sec, the brass plating layer of the surface of the steel wire begins to peel. The residual stress becomes zero when the parameter Sp reaches 200 kgf/cm$^2$.sec. Thereafter, the residual stress shifts from the tension side to the compression side.

Figure 5:
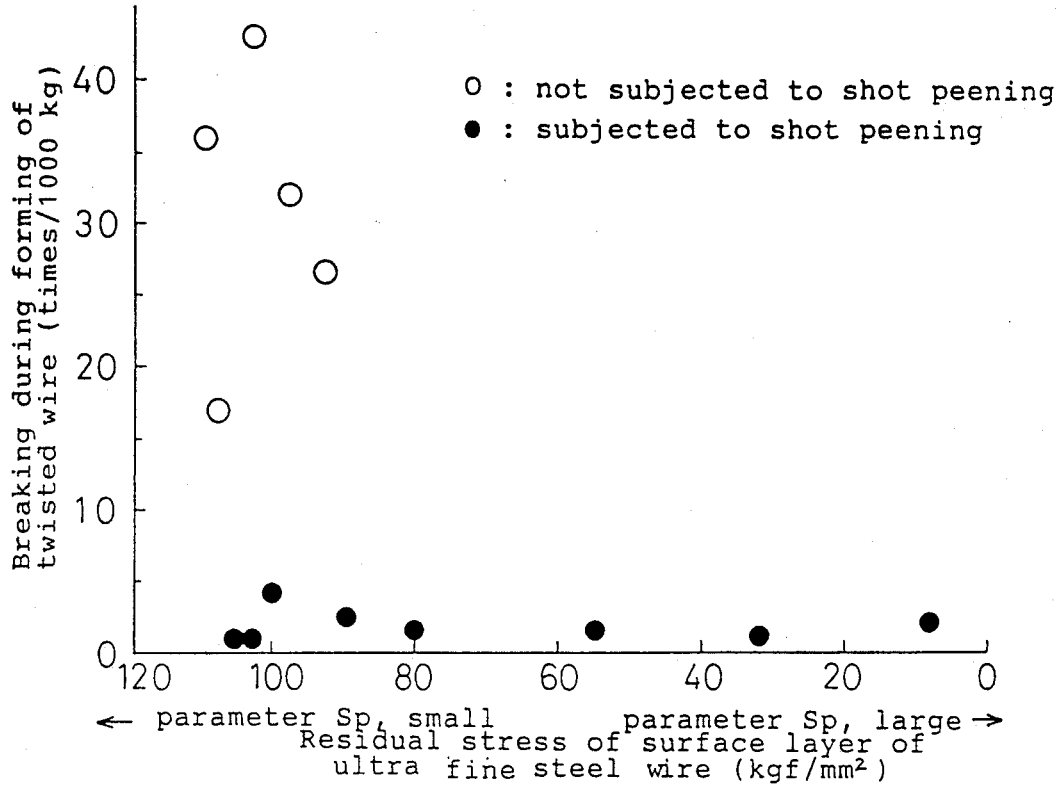
FIG. 5 is a diagram showing the results of an example of an analysis of the relationship between the residual stress of the surface layer of an ultra fine steel wire and the wire breaking frequency when twisting a wire.

FIG. 5 shows the relationship between the residual stress (kgf/mm$^2$) of the surface layer of the ultra fine steel wire in the steel wire of FIG. 4 and the wire breaking frequency (times/1000 kg) when twisting a wire. In samples subjected to shot peening according to the present invention (marked ● in the drawing), the wire breaking frequency is 5 times or less. On the other hand, in samples not subjected to shot peening (marked ○ in the drawing), the wire breaking frequency is 15 times or more.

That is, even though the shot peening treatment is conducted under a very mild condition of a parameter Sp of 100 kgf/cm$^2$.sec (residual stress: about 45 kgf/mm$^2$) or less by taking the peeling of brass plating into consideration, when the shot peening conditions (shot grain diameter and HV hardness of shot grain) of the present invention are satisfied, it is possible to significantly improve the workability in stranding of the wire.

Figure 6:
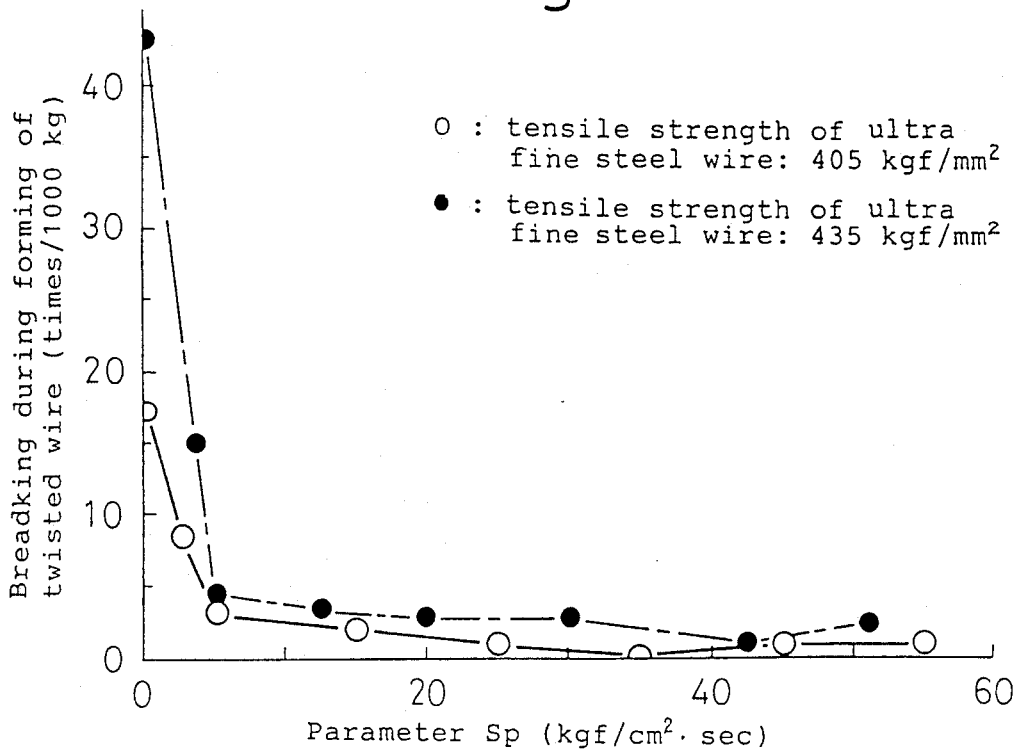
FIG. 6 is a diagram showing the results of an example of an analysis of the relationship between the parameter Sp during a shot peening treatment and the wire breaking frequency when twisting a wire.

The lower limit of the parameter Sp can be explained by an example shown in FIG. 6. FIG. 6 shows the relationship between the parameter Sp and the wire breaking frequency when twisting a wire in the case of Run No. 16 (marked ○ in the drawing) and Run No. 28 (marked ● on the drawing) in Example 2. When the Sp value is less than 5 kgf/cm$^2$.sec, the wire breaking frequency is rapidly increased.

Therefore, in the present invention, when the parameter Sp is less than 5 kgf/cm$^2$.sec, since the percentage area of indentations of the surface layer of a steel wire is small, and an even indentation cannot be provided, the effect of improving the workability in stranding of a high strength, ultra fine steel wire is low. On the other hand, when the parameter Sp exceeds 100 kgf/cm$^2$.sec, the effect of improving the workability in stranding of wire is saturated and the brass plating on the surface of the steel wire is peeled, so that, in a final stage, a problem arises in that the adhesion between the steel wire and the rubber is deteriorated. For this reason, the parameter Sp is limited to 5 to 100 kgf/cm$^2$. The air blast pressure is preferably from 3 to 8 kgf/cm$^2$. In this range, it is preferred to adjust the shot peening treatment time in such a manner that the Sp parameter is from 5 to 100 kgf/cm$^2$.

In the shot peening treatment of the present shot grain are specified as follows.

Shot grain diameter: When the shot grain diameter exceeds 100 μm, it becomes difficult for shot grains to evenly collide against the surface of an ultra fine steel wire having a wire diameter of 0.1 to 0.4 mm. Further, in this case, since the depth of indentations is liable to exceed 2 μm, the effect of improving the workability in stranding is small and a problem arises in that the brass plating becomes liable to peeling. For this reason, the shot grain diameter is limited to 100 μm or less. The shot grain diameter is preferably from 20 to 80 μm.

HV hardness of shot crain: When the HV hardness of the shot grain is less than 700, it becomes difficult to efficiently provide plastically deformed indentations on the surface layer of a high strength, ultra fine steel wire having a tensile strength of 400 kgf/mm$^2$ or more. For this reason, the HV hardness of the shot grain is limited to 700 or more.

When the reduction of area of an ultra fine steel wire after wire drawing is less than 30%, no improvement in the workability in stranding of wire can be expected even when the above-described shot peening treatment is conducted.

The brass plating of the surface layer of the steel wire according to the present invention is a plating comprising, in terms of % by weight, 50 to 75% of Cu and 25 to 50% of Zn with the balance consisting of unavoidable impurities. The brass plating is conducted after the patenting treatment for improving the wire drawability and the adhesion between the steel wire and the rubber. The thickness of the brass plating is preferably from 1 to 3 μm. In the present invention, although a high strength, ultra fine steel wire having a brass plating is contemplated, the effect of improving the workability in stranding of wire can be attained in the case of an ultra fine steel wire having a plating of Cu, Sn, Ni, Zn or the like, or an alloy plating thereof. There is no limitation on the plating.

Figure 7:
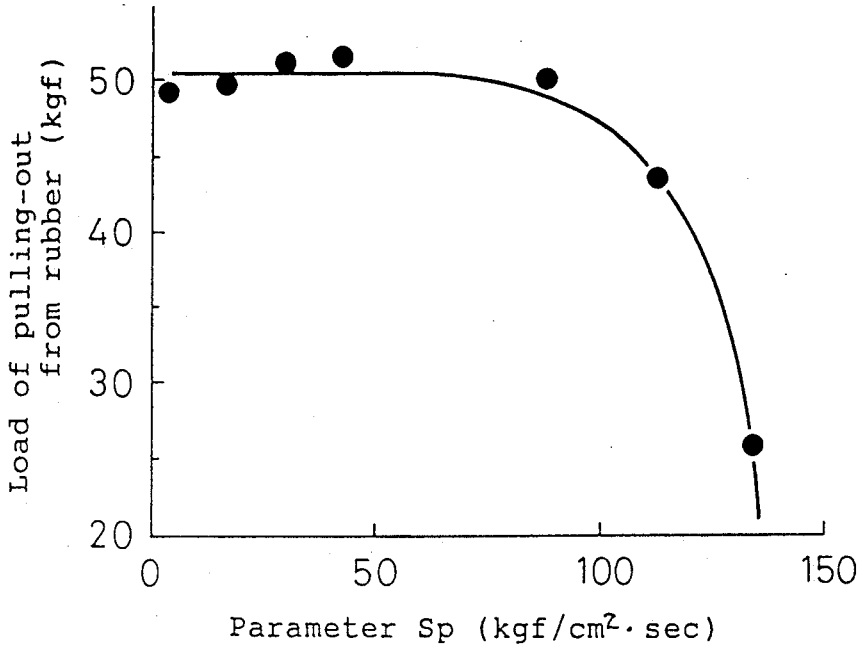
FIG. 7 is a diagram showing the results of an example of an analysis of the influence of the parameter Sp during a shot peening treatment on the adhesion between steel cords and rubber.

The ultra fine steel wire subjected to brass plating is then subjected to a shot peening treatment, and the influence of the parameter Sp on the adhesion between steels cords and rubber is shown in FIG. 7. The above-described adhesion is expressed in terms of the pull-out load (kgf) necessary for pulling steel cords out of the rubber. When the parameter Sp becomes 100 kgf/cm$^2$.sec or more, the adhesion between the steel cords and the rubber is rapidly lowered.

As described above, an optimal selection of the composition of the steel material, the tensile strength after patenting treatment and the wire drawing strain and a proper shot peening treatment of the ultra fine steel wire after wire drawing according to the present invention enables the occurrence of delamination to be prevented, so that it becomes possible to produce a high strength, ultra fine steel wire having an excellent wire workability in stranding, a wire diameter of 0.1 to 0.4 mm, and a strength of 400 kgf/mm$^2$ or more.

Figure 10:
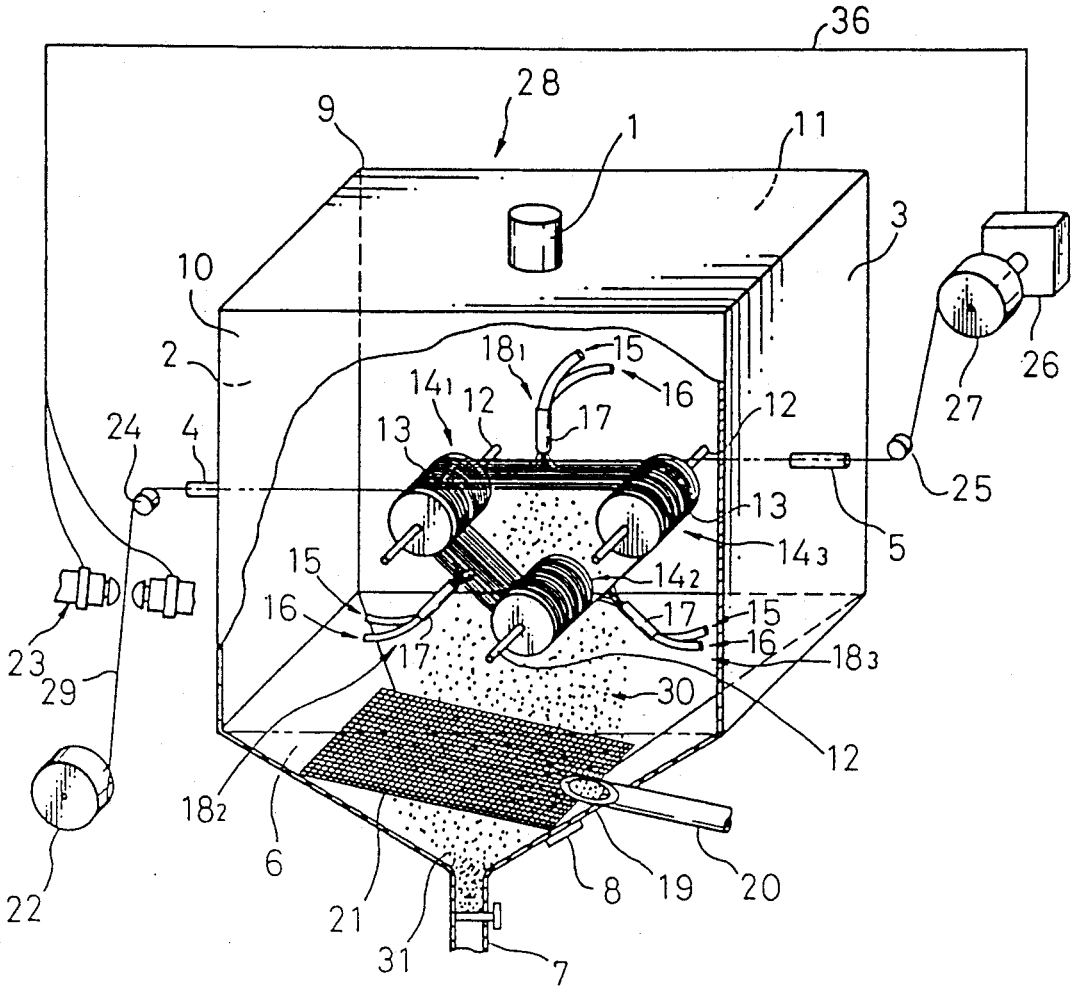
FIG. 10 is a partially sectional schematic perspective view of an apparatus of the present invention.
Figure 11:
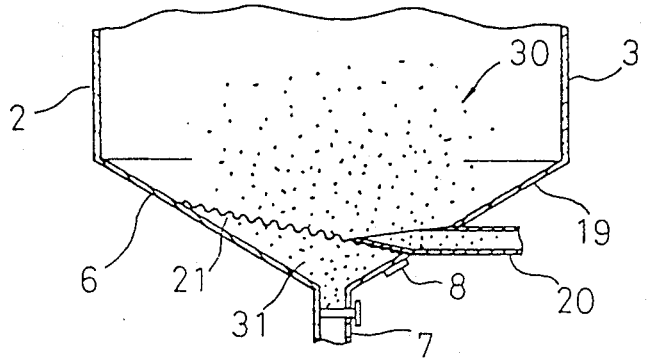
FIG. 11 is a partially front sectional view of FIG. 10.
Figure 12:
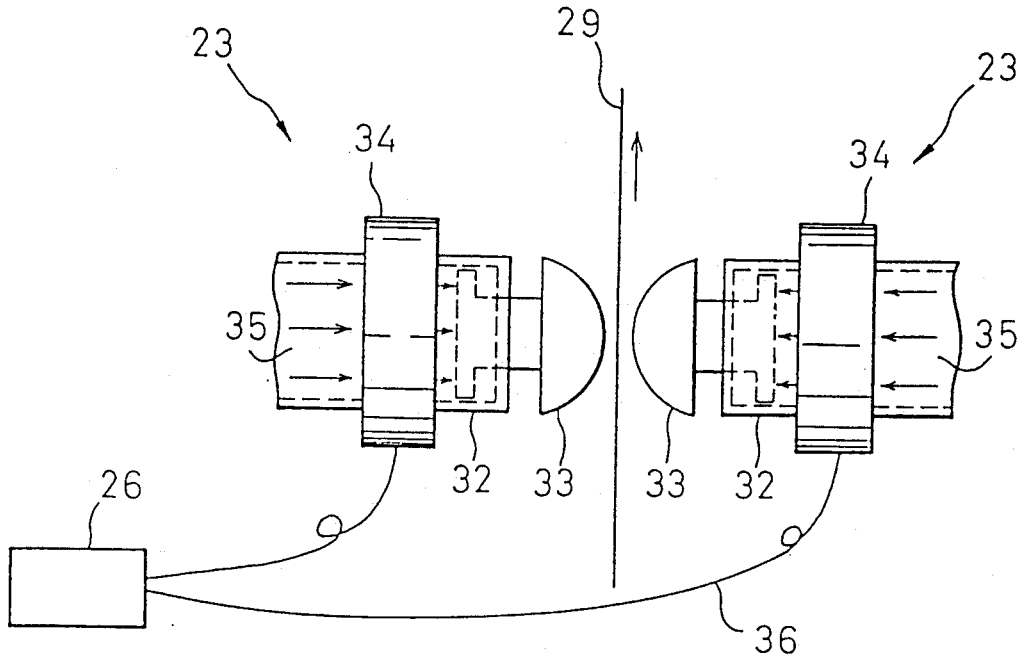
FIG. 12 is a partially enlarged front view of FIG. 10.

A shot peening apparatus used for practicing the present invention will now be described. FIG. 10 is a schematic view of an apparatus used for the shot peening treatment of an ultra fine steel wire. In the drawing, numeral 1 designates an exhaust hole, 2 and 3 are opposing side walls, 4 is an inlet of a steel wire, 5 is an outlet of a steel wire, 6 is an inclined bottom, 7 is a shot grain discharge pipe, 8 is an ultrasonic oscillation generating apparatus, 9 is a cabinet, 10 and 11 are side walls respectively orthogonal to side walls 2 and 3, 12 is a shaft for rotating a roller, 13 is a roller, $\mathbf{14}_1$ to $\mathbf{14}_3$ are each a steel wire winding roller, 15 is a compressed air feed hose, 16 is a shot grain feed hose, 17 is a nozzle, $\mathbf{18}_1$ to $\mathbf{18}_3$ are each a shot nozzle, 19 is a slanted wall, 20 is a shot grain recovery pipe, 21 is a shot grain sieve, 22 is an uncoiler, 23 is a tension control brake, 24 is an inlet guide roller, 25 is an outlet guide roller, 26 is a load measuring device, 27 is a winding coiler, 28 is a shot peening treatment apparatus, 29 is an ultra thin steel wire, 30 is a shot grain, and 31 is a broken shot grain. The ultra thin steel wire 29 is passed from the uncoiler 22 through the tension control brake 23 and the guide roller 24, subjected to a desired shot peening treatment within the shot peening treatment apparatus 28, and passed through the guide roller 25 to wind the steel wide by the winding coiler 27. FIG. 11 is a front sectional view wherein the vicinity of the shot grain discharge pipe 7 is shown in an enlarged state, to indicate the position for mounting the ultrasonic oscillation generating device 8. The shot grain sieve 21 is adapted for screening and recovering broken shot grains, and the ultrasonic oscillation generating device 8 is adapted for preventing a clogging of the sieve 21. FIG. 12 is a front enlarged view of the tension control brake 23.

The tension control brakes 23 each comprise a cylinder 32 and a brake 33, moveable by compressed air 35 and a solenoid valve 34, provided so as to face each other between the uncoiler 22 and the inlet guide roller 24. The solenoid valve 34 is connected to the load measuring device 26 through electrical wiring 36, and the air flow rate is regulated by an electric signal from the load measuring device 26. The flow rate is regulated when the tension of the steel wire 29 is lower than the lower limit of the load previously set in the load measuring device 26. When the lower limit of the load is less than 0.5 kgf, since the ultra fine steel wire relaxes, an efficient shot peening treatment cannot be conducted. For this reason, the load is limited to 0.5 kgf or more. The lower limit of load is 5 kgf at which the homogeneous peening effect is saturated in the shot peening.

The method of shot peening according to the present invention will be now described in more detail.

EXAMPLE 1

The chemical compositions of materials under test are given in Table 1. These materials under test were hot-rolled into wires having a diameter of 5.5 mm, which were subjected to primary wire drawing, primary patenting treatment and secondary wire drawing, to bring the wire diameter to 1.24 to 2.00 mm. Thereafter, these wires were subjected to a final patenting treatment (austenitizing temperature: 950° C., lead bath temperature: 560° to 600° C.), brass plating treatment, and wet wire drawing at a wire drawing rate of 600 m/min.

The resultant ultra fine steel wires having a wire diameter of 0.15 and 0.2 mm were subjected to a shot peening treatment by the following process.

As shown in FIG. 10, the ultra fine steel wires were delivered from an uncoiler bobbin 22 having a diameter of 150 mm at a rate of 600 m/min, subjected to a shot peening treatment within a shot peening cabinet 9 having a size of 1000×1000×1000 mm, and subjected to a shot peening treatment according to the present invention while winding the wires by a winding bobbin 27 having a diameter of 150 mm. The load measuring device 26 is adapted for measuring the tension of the ultra fine steel wire 29 and sending a signal to the control brake 23 when the tension falls below the set lower limit of the load. In the present test, the lower limit of the load was set to 0.5 kg, and the tension applied to the steel wire was limited to 0.7 kg on the average. The dead weight of the uncoiler was 7 kg. The area of contact of the tension control brake 23 with the ultra fine steel wire 29 comprised a hard rubber. As shown in FIG. 12, the tension is controlled by nipping or releasing the ultra fine steel wire 29 by an electric signal from the load measuring device 26. The shot grain 30 is a spherical steel bead, and the sieve 21 can be replaced at any time, depending upon the test. At that time, to eliminate a clogging of the sieve 21, an ultrasonic oscillation generating device 8 having an oscillation frequency of 50 kHz and a high frequency output of 60 W was provided close to the sieve 21 in the inclined wall 19 and outside the cabinet 9, to allow a degree of sieving of the shot grain 30 of substantially 100%. The shot nozzle $\mathbf{18}_1$ to $\mathbf{18}_3$ is an air suction system, and the nozzle 17 comprises a ceramic. The rollers 13 of the steel wire winding rollers $\mathbf{14}_1$ to $\mathbf{14}_3$ have a diameter of 100 mm and comprise a ceramic having a larger hardness than that of the shot grain 30. Up to three rollers can be provided at equal intervals in a center distance of the shaft 12 of 300 mm, and grooves having a depth of 1 mm and a pitch of 1 mm provided on the surface of the roller 13 so that the ultra fine steel wire 29 can be wound. The ultra fine steel wire 29 was wound 30 times. The steel wire winding rollers $\mathbf{14}_1$ to $\mathbf{14}_3$ were provided so as to be freely removable depending upon test conditions. The shaft 12 was engaged with the roller 13, for coping with the rotation at a high speed, depending upon the test conditions. Unbroken shot grains 30 after the shot peening treatment are recovered through the shot grain recovery pipe 20, repeatedly fed into the shot grain feed hose 16, and repeatedly and continuously projected through the ceramic nozzle 17. With respect to the compressed air, air in the atmosphere was dehumidified to a humidity of 20% or less to prevent the shot grain 30 from condensing, and continuously fed at a constant presure of 5 kgf/cm$^2$ by a compressor through a compressed air feed hose 15.

The steel wire thus obtained was transferred to a double twister type twisting machine, where 1000 kg of the steel wire was subjected to double twisting (pitch: 5 mm) at 16,000 rpm.

Table 2 shows the influence of the depth of indentations, intervals of indentations and percentage area of indentations of the surface layer of an ultra fine steel wire on the mechanical properties of the ultra fine steel wire, and the wire breaking frequency and rotary bending fatigue. In the wire twisting test, the wire workability in stranding was evaluated based on the wire breaking frequency per 1000 kg in the above-described twisting machine. In the evaluation, when the wire breaking frequency was 5 times or less, the wire workability in stranding was evaluated as acceptable, and when the wire breaking frequency exceeded 5 times, the wire workability in stranding was evaluated as unacceptable, due to a lowering of the productivity. The fatigue properties were evaluated by conducting a rotary bending test under a stress of 100 kgf/mm$^2$, to determine the number rotations necessary for a breaking of the wire. In Table 2, Run Nos. 2, 7, 9 and 10 are examples of the present invention, and the other Run Nos. are comparative examples. As can be seen from the table, in all examples of the present invention, the wire breaking frequency when twisting an ultra fine steel wire having a tensile strength of 400 kgf/mm$^2$ or more was very small, and the steel wires had an excellent wire workability in stranding. Further, it is apparent that an improvement in the fatigue properties can be attained. On the other hand, all the Run Nos. 1, 6 and 8 as comparative examples are ultra fine steel wires produced by the conventional process and free from indentations on the surface layer. In this case, the wire breaking frequency when twisting a wire was very large. In Run Nos. 3 to 5, as comparative examples, since the depth, intervals and percentage area of impressions formed by plastic deformation on the surface layer of an ultra fine steel wire are improper, no significant improvement in the wire workability in stranding can be attained, or the fatigue properties were deteriorated. Specifically, the wire breaking frequency exceeds five times due to excessively large intervals of indentations in the case of Run Nos, 3, and an excessively small percentage area of indentations in the case of Run No. 4. In the case of Run No. 5, since the depth of the indentations exceeds 2 μm, the wire breaking frequency exceeded five times, and fatigue properties were deteriorated.

TABLE 1

| Type of steel | C | Si | Mn | P | S | Cr | Ni | Co | Al |
|---|---|---|---|---|---|---|---|---|---|
| A | 0.81 | 0.26 | 0.48 | 0.009 | 0.007 | — | — | — | 0.0012 |
| B | 0.83 | 0.21 | 0.51 | 0.005 | 0.006 | 0.27 | — | — | 0.0015 |
| C | 0.93 | 0.23 | 0.51 | 0.008 | 0.008 | — | — | — | 0.0016 |
| D | 0.88 | 0.49 | 0.30 | 0.010 | 0.005 | 0.51 | — | — | 0.0016 |
| E | 1.05 | 0.12 | 0.24 | 0.007 | 0.009 | 0.15 | 0.23 | 1.08 | 0.0011 |
| F | 0.86 | 0.48 | 0.57 | 0.006 | 0.005 | 0.36 | — | 0.24 | 0.0009 |
| G | 0.98 | 0.21 | 0.31 | 0.004 | 0.006 | 0.21 | — | — | 0.0010 |
| H | 0.89 | 0.67 | 0.31 | 0.009 | 0.007 | 0.59 | — | 2.81 | 0.0011 |
| I | 0.95 | 0.30 | 0.29 | 0.005 | 0.008 | 0.26 | 1.81 | — | 0.0013 |
| J | 0.90 | 0.26 | 0.41 | 0.009 | 0.008 | 0.37 | — | — | 0.0014 |

after the patenting treatment is low. On the other hand, in Run No. 13, although the tensile strength after the patenting treatment is high, since no Cr is contained, the percentage of work hardening when wire drawing is low. In both cases, an intended tensile strength of 400 kgf/mm$^2$ or more could not be attained. Run Nos. 12 and 14 are each an example wherein the wire drawing strain is increased for enhancing the tensile strength of the ultra fine steel wire. In No. 12, since the wire drawing strain is high, a wire breaking frequently occurs during the wire drawing. On the other hand, in Run No. 14, the reduction of area of the ultra fine steel wire is so low that no improvement in the wire workability in stranding can be attained even when the ultra fine steel

TABLE 2

| Run No. | Type of steel | Mechanical properties of ultra fine steel wire: wire diameter mm | tensile strength kgf/mm$^2$ | reduction of area % | Impressions of surface layer of ultra fine steel wire: depth μm | intervals μm | percentage area (%) | Shot peening conditions: shot grain diameter μm | HV hardness of shot grain | Parameter Sp kgf/cm$^2$ · sec | Breaking of wire during twisting of wire (times) | Rotary bending fatigue (times) |
|---|---|---|---|---|---|---|---|---|---|---|---|---|
| 1 | D | 0.20 | 405 | 35 | — | — | — | — | — | — | 17 | 18,500 |
| ② | D | 0.20 | 405 | 35 | 0.2 | 18 | 38 | 50 | 790 | 29 | 1 | 35,500 |
| 3 | D | 0.20 | 405 | 35 | 0.2 | 59 | 25 | 50 | 550 | 16 | 6 | 24,500 |
| 4 | D | 0.20 | 405 | 35 | 0.2 | 34 | 6 | 70 | 630 | 4 | 13 | 21,000 |
| 5 | D | 0.20 | 405 | 35 | 2.3 | 21 | 60 | 240 | 850 | 72 | 10 | 9,500 |
| 6 | E | 0.20 | 428 | 32 | — | — | — | — | — | — | 38 | 21,000 |
| ⑦ | E | 0.20 | 428 | 32 | 0.5 | 15 | 71 | 30 | 910 | 86 | 2 | 41,500 |
| 8 | F | 0.15 | 435 | 34 | — | — | — | — | — | — | 43 | 23,000 |
| ⑨ | F | 0.15 | 435 | 34 | 1.6 | 28 | 74 | 90 | 910 | 71 | 4 | 35,500 |
| 10 | F | 0.15 | 435 | 34 | 0.2 | 11 | 57 | 30 | 910 | 63 | 3 | 43,000 |

Note) ○: example of the present invention

EXAMPLE 2

The influence of mechanical properties after patenting treatment and wire drawing conditions on the mechanical properties of ultra fine steel wires when using the materials under test listed in Table 1 are given in Table 3. The shot peening treatment conditions for improving the workability in stranding of a high strength, ultra fine steel wire and the wire breaking frequency when twisting a wire are also given in Table 3. The heat treatment conditions for patenting, wire drawing conditions, and wire workability in stranding were evaluated by the same method as described above (Example 1).

Run Nos. 16, 19 to 21 and 25 to 28 in Table 3 are examples of the present invention, and the other Run Nos. are comparative examples. As can be seen from the table, in all examples of the present invention, the tensile strength of the ultra fine steel wire was 400 kgf/mm$^2$ or more as contemplated in the present invention. Further, since the shot peening conditions were in a proper range, the depth, intervals and percentage area of indentations also are optimal, so that the wire breaking frequency is low and the production of a high strength, ultra fine steel wire having an excellent workability in stranding can be realized.

On the other hand, with respect to comparative examples, SWRS82A is used in Run Nos. 11 and 12, and SWRS92A is used in Run Nos. 13 and 14. In Run No. 11, since the C content is so low, the tensile strength wire is subjected to a shot peening treatment.

Further, in No. 15 as a comparative example, although Cr is added, since the C content is so low that a tensile strength of 145 kgf/mm$^2$ or more cannot be obtained after the patenting treatment, it becomes impossible for the tensile strength of the final ultra fine steel wire to reach 400 kgf/mm$^2$ or more.

In Run No. 17, although the tensile strength after the patenting treatment was as high as 150 kgf/mm$^2$, since the wire drawing strain was so low, the tensile strength of the ultra fine steel wire was less than 400 kgf/mm$^2$.

In Run Nos. 18, 22 and 23 as comparative examples, although the tensile strength of the ultra fine steel wire was 400 kgf/mm$^2$ or more, since the shot peening conditions were improper, no improvement in the workability in stranding of wire could be attained. In No. 18, since no shot peening treatment was conducted, the wire breaking frequency when twisting a wire is high. Although the wire breaking frequency when twisting is lowered, the wire breaking frequency does not reach 5 times or less due to an excessively large shot grain diameter in the case of Run No. 12 and an excessively low parameter Sp in the case of Run No. 23. In Run No. 24 as a comparative example, although the tensile strength and workability in stranding of wire each reach an intended level, the parameter Sp in the shot peening treatment is so large that the brass plating is peeled off and the adhesion between the steel wire and the rubber is lowered.

TABLE 3

| Run No. | Mechanical properties after patenting: type of steel | tensile strength kgf/mm² | reduction of area % | Wire drawing conditions: material wire diameter mm | finished wire diameter mm | true strain | Mechanical properties of ultra fine steel wire: tensile strength kgf/mm² | reduction of area % | Shot peening conditions: shot grain diameter μm | HV hardness of shot grain | Parameter Sp kgf/cm² · sec | Breaking of wire during twisting of wire (times) |
|---|---|---|---|---|---|---|---|---|---|---|---|---|
| 11 | A | 135 | 45 | 1.34 | 0.20 | 3.80 | 358 | 47 | — | — | — | 4 |
| 12 | A | 134 | 44 | 1.55 | 0.20 | 4.10 | — | — | — | — | — | — |
| 13 | C | 147 | 42 | 1.33 | 0.20 | 3.79 | 375 | 40 | — | — | — | 9 |
| 14 | C | 144 | 41 | 1.48 | 0.20 | 4.00 | 395 | 23 | 50 | 845 | 28 | 32 |
| 15 | B | 142 | 39 | 1.34 | 0.20 | 3.80 | 377 | 39 | 50 | 845 | 32 | 1 |
| ⑯ | D | 151 | 46 | 1.40 | 0.20 | 3.89 | 405 | 35 | 50 | 790 | 42 | 1 |
| 17 | D | 150 | 45 | 1.24 | 0.20 | 3.64 | 380 | 43 | 50 | 790 | 45 | 0 |
| 18 | D | 151 | 46 | 1.40 | 0.20 | 3.89 | 405 | 35 | — | — | — | 17 |
| ⑲ | E | 162 | 43 | 1.42 | 0.20 | 3.92 | 428 | 32 | 70 | 910 | 28 | 2 |
| ⑳ | F | 149 | 47 | 1.45 | 0.20 | 4.03 | 414 | 37 | 70 | 910 | 33 | 1 |
| ㉑ | G | 153 | 42 | 1.96 | 0.30 | 3.75 | 409 | 38 | 30 | 850 | 36 | 1 |
| 22 | G | 153 | 42 | 1.96 | 0.30 | 3.75 | 409 | 38 | 120 | 850 | 36 | 8 |
| 23 | H | 154 | 46 | 1.41 | 0.20 | 3.91 | 417 | 35 | 80 | 830 | 3 | 16 |
| 24 | H | 154 | 46 | 1.41 | 0.20 | 3.91 | 417 | 35 | 80 | 830 | 130 | 3 |
| ㉕ | H | 154 | 46 | 1.41 | 0.20 | 3.91 | 417 | 35 | 80 | 830 | 54 | 2 |
| ㉖ | I | 154 | 45 | 1.38 | 0.20 | 3.86 | 415 | 34 | 30 | 740 | 91 | 1 |
| ㉗ | J | 158 | 45 | 2.00 | 0.30 | 3.79 | 408 | 37 | 30 | 740 | 7 | 4 |
| ㉘ | F | 150 | 48 | 1.25 | 0.15 | 4.24 | 435 | 34 | 50 | 790 | 28 | 3 |

Note) ○: example of the present invention

EXAMPLE 3

Table 4 shows the influence of the Sp parameter in the shot peening treatment on the wire breaking frequency, the adhesion between rubber and steel cords, and the rotary bending fatigue properties. After the wire drawing, the shot peening treatment was conducted under conditions of a shot grain diameter of 50 μm and a HV hardness of shot grain of 850, 1×7×0.2 twisted cords were used as the steel cords, and a compounded rubber given in Table 5 was used as the rubber. Steel cords having a length of 12.5 mm were embedded in an unvulcanized rubber, and vulcanization was conducted at 150° C. for 30 min. A load necessary for pulling the steel cords out of the vulcanized rubber was measured, to evaluate the adhesion between the rubber and the cords. In the measurement of the rotary bending fatigue properties, the fatigue strength of cords provided with rubber was determined in 15 cords by a staircase method, at a test repetition of $5\times10^6$.

Run Nos. 31, 32 and 36 to 38 in Table 4 are examples of the present invention, and the other Run Nos. are comparative examples. As can be seen from Table 4, all examples of the present invention exhibit a low wire breaking frequency when twisting a wire and an excellent adhesion between the steel cords and the rubber in ultra fine steel wires having a tensile strength of 400 kgf/mm² or more. Further, in this case, the fatigue strength of the cords is superior to that of cords not subjected to a shot peening treatment.

On the other hand, in Run Nos. 29 and 35 as comparative examples which have not been subjected to a shot peening treatment, the wire breaking frequency is high. In Run No. 30 as a comparative example, since the parameter Sp at the shot peening treatment is too small, the effect of the shot peening is so small that the wire breaking frequency does not reach the 5 times or less contemplated in the present invention. Further, in Run Nos. 33, 34 and 39 as comparative examples, although the wire workability in stranding and the fatigue strength of the cords are superior, since the parameter Sp is too large, the brass plating is peeled off, and thus the adhesion between the cords and the rubber is deteriorated.

TABLE 4

| Run No. | Type of steel | Mechanical properties of ultra fine steel wire: tensile strength kgf/mm² | reduction of area % | Parameter Sp kgf/cm² · sec | Breaking of wire during twisting of wire (times) | Adhesion between rubber and cords kgf | Fatigue strength of cords kgf/mm² |
|---|---|---|---|---|---|---|---|
| 29 | D | 405 | 35 | 0 | 17 | 49.2 | 98 |
| 30 | D | 405 | 35 | 3 | 9 | 50.1 | 100 |
| 31 | D | 405 | 35 | 42 | 1 | 51.8 | 126 |
| 32 | D | 405 | 35 | 86 | 0 | 50.3 | 134 |
| 33 | D | 405 | 35 | 107 | 1 | 43.5 | 136 |
| 34 | D | 405 | 35 | 131 | 2 | 31.2 | 138 |
| 35 | E | 428 | 32 | 0 | 36 | 49.6 | 94 |
| 36 | E | 428 | 32 | 9 | 4 | 49.9 | 102 |
| 37 | E | 428 | 32 | 28 | 2 | 51.3 | 120 |
| 38 | E | 428 | 32 | 67 | 1 | 52.1 | 132 |
| 39 | E | 428 | 32 | 123 | 2 | 37.5 | 136 |

Note): example of the present invention

TABLE 5

| Compounding agent | Parts by weight |
|---|---|
| natural rubber | 100 |
| zinc oxide | 7 |
| carbon black | 50 |
| sulfur | 5 |
| stearic acid | 1 |
| cobalt naphthenate | 1 |

TABLE 5-continued

| Compounding agent | Parts by weight |
|---|---|
| softening agent | 3 |
| vulcanization accelerator | 1 |

In the present examples, a steel wire was wound around the roller 14 and subjected to shot peening while applying tension. The wire breaking frequency when twisting a wire si given in Table 6, in comparison with that where no tension was applied and that where the tension was applied by an ungrooved roller.

TABLE 6

| | Grooves of roller | Control of tension | Tension (kgf) | Wire breaking frequency when twisting (times/1000 kg) |
|---|---|---|---|---|
| Present invention | grooved | controlled | 0.7 | 3 |
| Comp. 1 | grooved | not controlled | 0.3 | 13 |
| Comp. 2 | ungrooved | controlled | 0.8 | 9 |

In Comparative 1, since the tension of the ultra fine steel wire is below the set value of the lower load limit and no tension control device was operated, the ultra fine steel wire was relaxed and deviated from a proper projection range. This prevented the shot grain from evenly colliding against the surface of the ultra fine steel wire, and thus a sufficient effect could not be attained.

In Comparative 2, since use was made of a steel wire winding roller not provided with grooves, the ultra fine steel wires overlapped each other on the winding roller, which prevented the ultra fine steel wires from being evenly subjected to shot peening, so that a satisfactory improvement effect could not be obtained.

By contrast, all examples of the present invention exhibited good results. This is attributable to the provision of grooves capable of winding the ultra fine steel wire on the surface of the steel wire winding roller within the conventional shot peening treatment device, to complete a treatment method suitable for ultra fine steel wires for enhancing the productivity, and further, the prevention of relaxation through the mounting of a device for controlling the tension of an ultra fine steel wire during a shot peening treatment to enable the shot peening treatment to be conducted under constant conditions. From these facts, it is apparent that the shot peening treatment apparatus of the present invention is useful for an ultra fine steel wire.

Industrial Applicability

As described above, the present invention enables a high strength, ultra fine steel wire having a wire diameter of 0.1 to 0.4 mm, a tensile strength of 400 kgf/mm$^2$ or more, and an excellent workability in stranding to be produced through an optimal selection of chemical ingredients, a tensile strength after patenting treatment, and wire drawing strain. The steel wire can be used as an element wire for a steel tire cord, a steel belt cord, etc., and the effect of the present invention is very significant from the viewpoint of industry.

We claim:

1. A high strength, ultra fine steel wire having an excellent workability in stranding comprising a steel having a composition consisting essentially of, in terms of % by weight, 0.85 to 1.10% of C, 0.10 to 0.70% of Si, 0.20 to 0.60% of Mn, 0.10 to 0.60% of Cr and 0.005% or less of Al with the balance Fe and unavoidable impurities and, provided thereon, a brass plating, said steel wire having a diameter of 0.1 to 0.4 mm and a tensile strength of 400 kgf/mm$^2$ or more, the surface of the brass plating being provided with indentations formed by plastic deformation having a depth of 2 μm or less at intervals of 50 μm or less in a percentage area of indentations of 10 to 80%.

2. The ultra fine steel wire according to claim 1, which further has, in terms of % by weight, at least one of 0.10 to 2.00% of Ni and 0.10 to 3.00% of Co.

3. A process for producing a high strength, ultra fine steel wire comprising:

subjecting a steel wire material having a composition consisting essentially of, in terms of % by weight, 0.85 to 1.10% of C, 0.10 to 0.70% of Si, 0.20 to 0.60% of Mn, 0.10 to 0.60% of Cr and 0.005% or less of Al with the balance Fe and unavoidable impurities to a patenting treatment so as to have a tensile strength of 145 to 165 kgf/mm$^2$;

plating the treated steel wire material with brass;

subjecting the plated steel wire material to wire drawing under a true strain of 3.7 to 4.5 to form a steel wire having a diameter of 0.1 to 0.4 mm;

subjecting the steel wire to a shot peening treatment in an air blast system through the use of compressed air under conditions of a shot grain diameter of 100 μm or less, a HV hardness of a shot grain of 700 or more, a Sp value [Sp=air blast pressure (kgf/cm$^2$)×shot peening treatment time (sec)] of 5 to 100 kgf/cm$^2$.sec.

4. The process according to claim 3, wherein said steel wire material further has, in terms of % by weight, at least one of 0.10 to 2.00% of Ni and 0.10 to 3.00% of Co.

5. The process according to claim 3 or 4, wherein the shot peening treatment is conducted while applying a tension of 0.5 to 5.0 kgf to said ultra fine steel wire.

6. A shot peening treatment apparatus for an ultra fine steel wire, comprising a plurality of rotatable steel wire winding rolls provided within a cabinet (9) and a shot nozzle provided between said rollers, an ultra fine steel wire (29) being wound around said rollers and travelled to conduct a shot peening treatment, characterized in that a tension control brake is provided on the upstream side of said rollers.

7. The apparatus according to claim 6, wherein the ultra fine steel wire can be wound around the surface of the steel wire winding rollers.

8. The apparatus according to claim 6, wherein said tension control brake is attached to a load measuring device having a tension set to a predetermined value.

* * * * *